US006126576A

United States Patent [19]

Wang

[11] Patent Number: 6,126,576

[45] Date of Patent: Oct. 3, 2000

[54] FASTENER FOR RUNWAY BOARD OF JOGGING DEVICE

[76] Inventor: Leao Wang, No 1, Lane 154, Charng Long Rd., Taiping City, Taichung, Taiwan

[21] Appl. No.: 09/328,380

[22] Filed: Jun. 9, 1999

[30] Foreign Application Priority Data

Dec. 24, 1998 [DE] Germany ..... 298 23 040 U

[51] Int. Cl.[7] ..... A63B 22/00

[52] U.S. Cl. ..... 482/54; 482/51

[58] Field of Search ..... 482/51, 54

[56] References Cited

U.S. PATENT DOCUMENTS

| | | | |
|---|---|---|---|
| 931,394 | 8/1909 | Day | 482/54 |
| 5,772,560 | 6/1998 | Watterson et al. | 482/54 |
| 5,899,834 | 5/1999 | Dalebout et al. | 482/54 |
| 5,921,893 | 7/1999 | Hurt | 482/54 |

*Primary Examiner*—Glenn E. Richmon
*Attorney, Agent, or Firm*—Dougherty & Troxell

[57] ABSTRACT

The present invention relates to a fastener for runway board of jogging device on which a front supporting frame of a jogging device at a certain position adjacent to a pivot of a runway board is connected with a plate on which a pull button is mounted for fastening, whereby a blocking axle of the pull button protrudes toward the runway board; thereafter a fan-shaped member with two inserted holes is fixed on the corresponding side of the pivot of the runway board to the blocking axle of the pull button, so that the blocking axle of the pull button can be inserted into the corresponding inserted holes of the fan-shaped member of the runway board no matter the runway board is placed at a using or at a folded position. Accordingly, the runway board is blocked in order not to turn around on its own through unexpected external force, and the safety of the user and persons around is able to be ensured.

2 Claims, 4 Drawing Sheets

FASTENER FOR RUNWAY BOARD OF JOGGING DEVICE

BACKGROUND OF THE INVENTION

1. Field of the Invention

The present invention relates to a fastener for runway board of jogging device, and more particularly to a fastener by which the runway board can be blocked in order not to turn around on its own through unexpected external force no matter the runway board is placed at a using or at a folded position, accordingly the safety of the user and persons around is able to be ensured.

2. Description of the Prior Art

The conventional runway is a caterpillar type indoor gymnastic device. A conventional runway disclosed in the U.S. Pat. No. 5,676,624, as shown in FIG. 7, includes a front supporting frame 12 at the bottom end of a handle frame 11 at the front end of the unit 10. In cooperation with a rear supporting frame 14 at the bottom end of the back side of a runway board 13, the runway board 13 is able to decline slightly in a state of touching ground (using state) when the unit 10 is placed for using. Accordingly, the user can make a jogging exercise on a runway band 15 thereof. However, the unit 10 occupies a large space so that a pivot 16 is mounted between the handle frame 11 and the runway board 13 so as to turn the runway board 13 upwards around in a standing state, whereby the occupied space can be reduced for better storage and carrying.

Nevertheless, this results in a great shaking state between the handle frame 11 and the runway board 13 due to the existence of the pivot 16. Therefore, it's likely to lead to a rapid malfunction of the pivot 16. Moreover, provided that the user goes on making a jogging exercise while the center of gravity of his body is shifted to the handle frame 11 when his both hands hold the handle 17 of the handle frame 11, then, owing to the great reactive force, the runway board 13 turns upwards around the pivot 16. It will bring the user in panic and fear while he could fall forward outside of the runway board 13 and his body might therefore injured in serious situation.

SUMMARY OF THE INVENTION

It is a main object of the present invention to provide a fastener for runway board of jogging device which includes a easy configuration and can ensure the using safety so that the user won't have fear in using and his body can be protected from injury.

In order to reach the above object, the present invention includes a pull button and a blocking axle. In cooperation with a fan-shaped member fixed on one side of the pivot of the runway board and two corresponding holes arranged thereon, the runway board can be fastened therewith, no matter the runway board is placed in a horizontal state for using or at a folded position in upwards turning-around state.

BRIEF DESCRIPTION OF THE DRAWINGS

The drawings disclose illustrative an embodiment of the present invention which serves to exemplify the various advantages and objects hereof, and are as follows.

DETAILED DESCRIPTION OF THE PREFERRED EMBODIMENT

Figure 1:
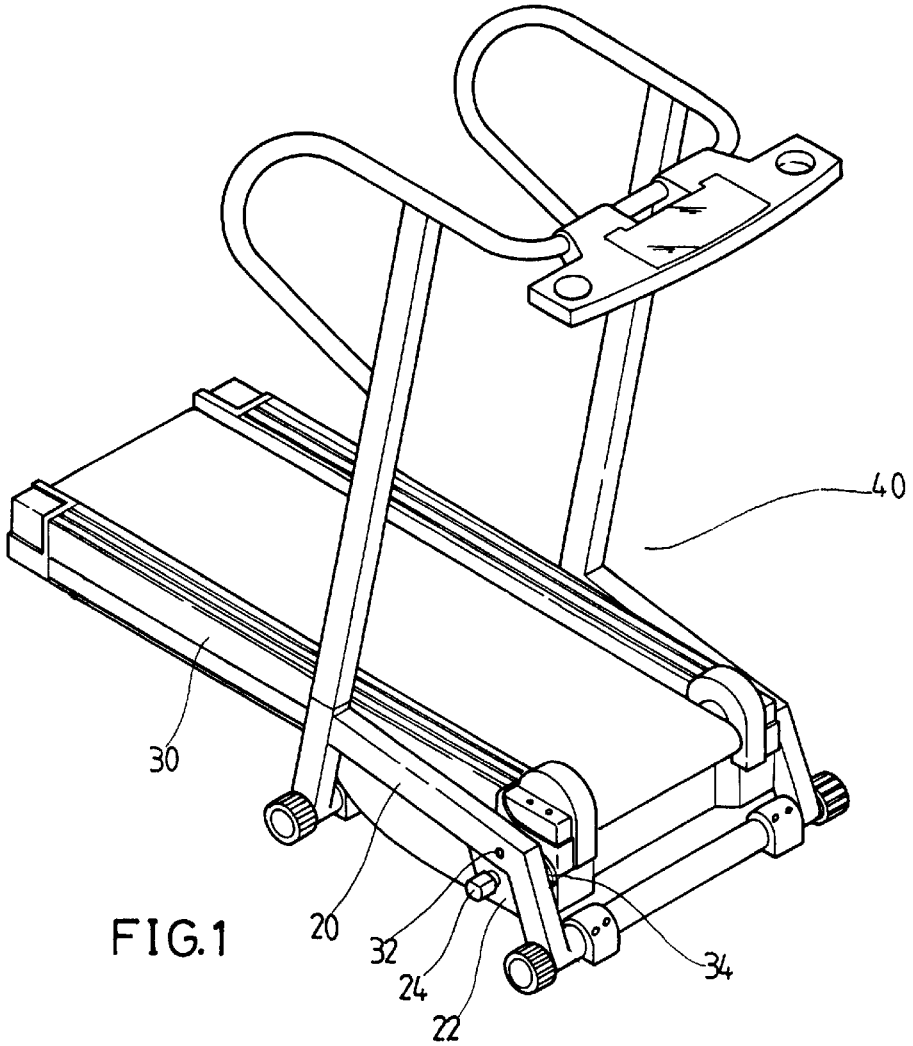
FIG. 1 is a perspective assembly view of the present invention.
Figure 2:
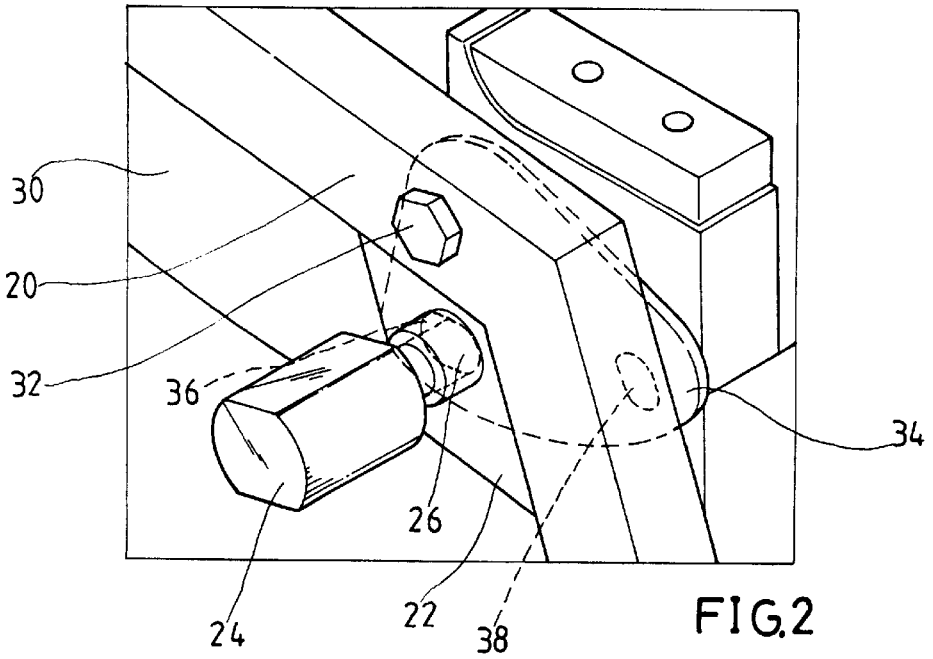
FIG. 2 is a partially expanded view of the present invention.

First of all, referring to FIG. 1 and 2, a front supporting frame 20 of a jogging device 40 in accordance with the present invention at a certain position adjacent to a pivot 32 of a runway board 30 is connected with a plate 22 on which a pull button 24 is mounted for fastening, whereby a blocking axle 26 of the pull button 24 protrudes toward the runway board 30; thereafter, a fan-shaped member 34 with two inserted holes 36, 38 is fixed on the corresponding side of the pivot 32 of the runway board 30 to the blocking axle 26 of the pull button 24.

Figure 5:
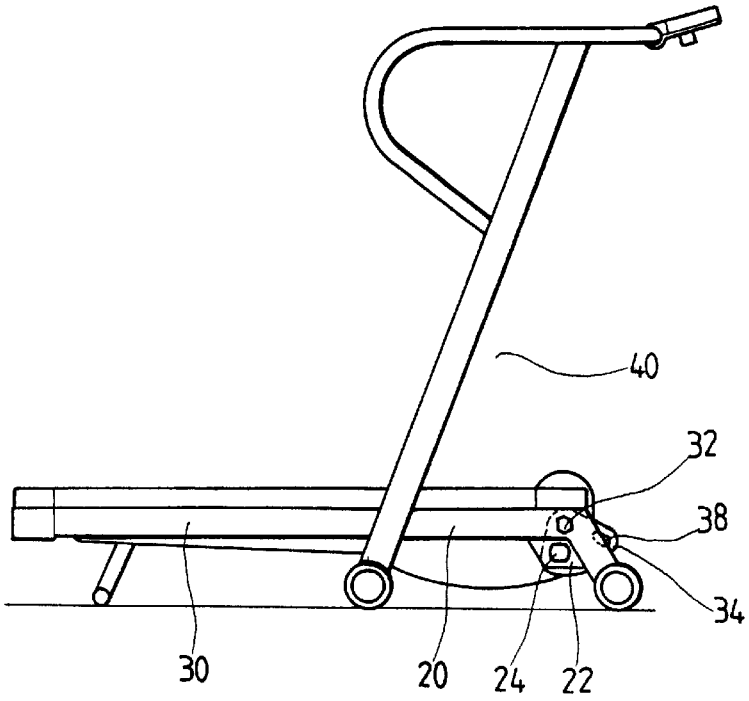
FIG. 5 is a schematic drawing of the present invention in a using state.
Figure 6:
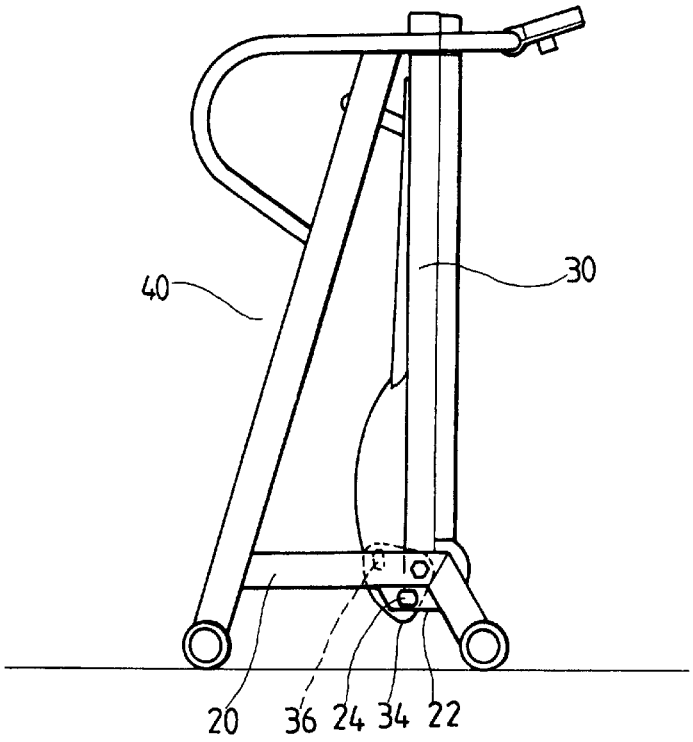
FIG. 6 is a schematic drawing of the present invention in a folded standing state.
Figure 7:
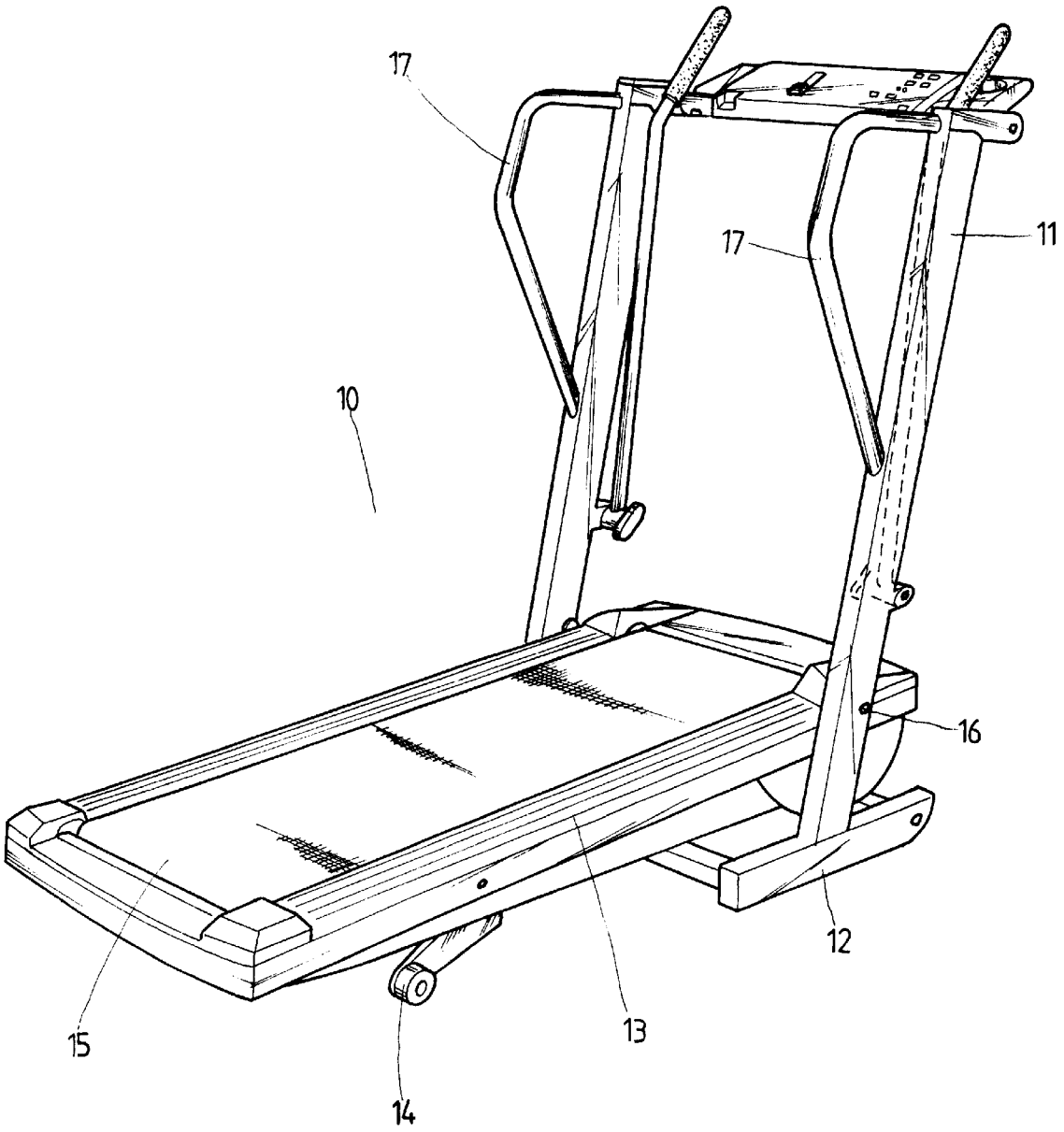
FIG. 7 PRIOR ART
FIG. 7 is a perspective view of the prior art in accordance with U.S. Pat. No. 5,676,624.

As shown in FIGS. 5 and 6, when the runway board 30 turning around, the fan-shaped member 34 revolves around the pivot 32, so that the blocking axle 26 of the pull button 24, as shown in FIG. 2, can be inserted into the corresponding inserted holes 36, 38 of the fan-shaped member 34 of the runway board 30, no matter the runway board 30 is placed in a horizontal state for using, as shown in FIG. 5 or at a folded position in upwards turning-around state, as shown in FIG. 6, whereby the runway board 30 is blocked in order not to turn around on its own through unexpected external force. Accordingly, the safety of the user and persons around is able to be ensured.

Figure 4:
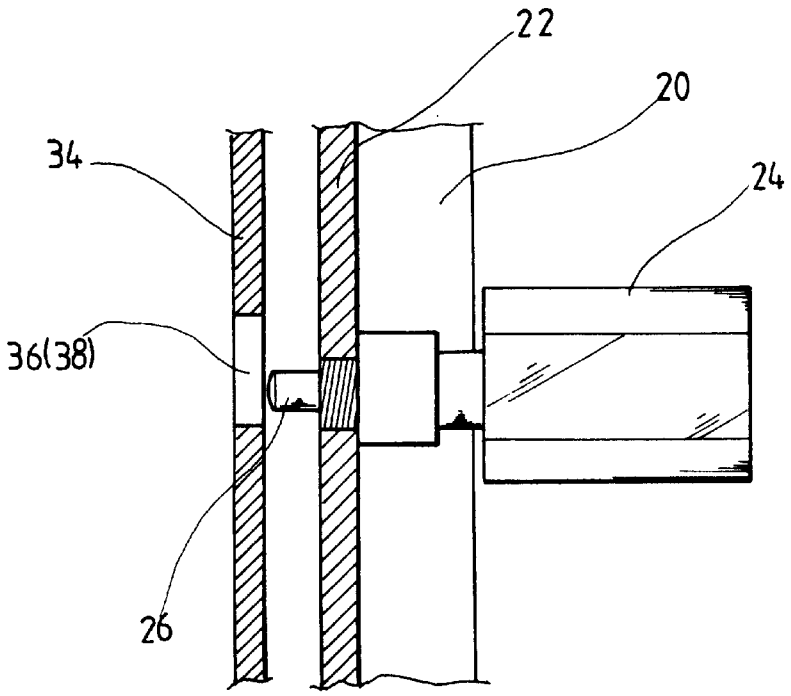
FIG. 4 is a partially sectional view of the present invention in releasing the fastening state.
Figure 3:
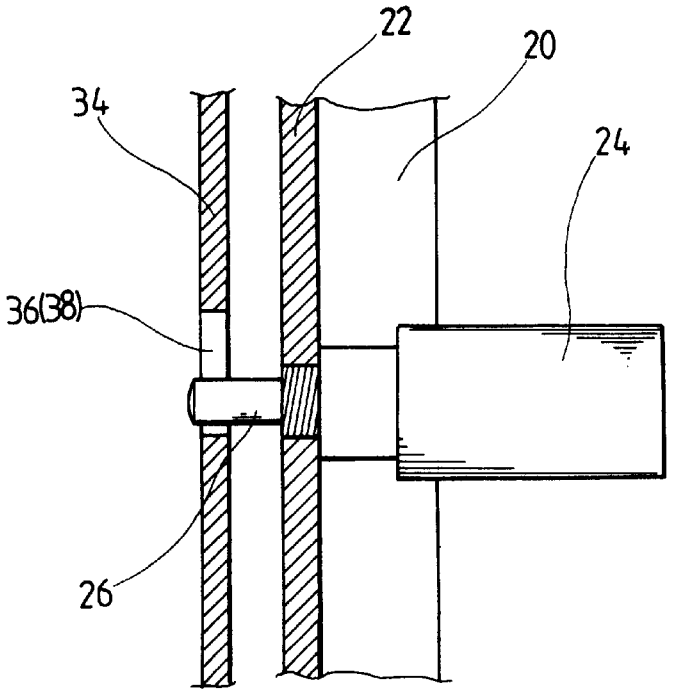
FIG. 3 is a partially sectional view of the present invention in a fastening state.

Similarly, when the runway board 30 is turned upward to be placed vertically or downward horizontally in accordance with the effect of the pivot 32, it's only necessary to pull the blocking axle 26 of the pull button 24 outwards to release the fastening effect, as shown in FIG. 4, and to be divorced from the corresponding inserted holes 36, 38 of the fan-shaped member 34 of the runway board 30. Therefore, the turning-around operation of the runway board 30 can be achieved.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A fastener for a runway board of a jogging device having a front supporting frame pivotally connected to the runway board such that the runway board may be moved between a use position and a storage position, the fastener comprising:

a) a plate fixedly located on the front supporting frame adjacent to the pivot connection between the runway board and the front supporting frame;

b) a fan-shaped member on the runway board so as to pivot therewith, the fan-shaped member having first and second spaced apart holes; and, c) a pull button located on the plate and having a blocking axle protruding therefrom, the blocking axle being movable between extended and retracted positions, whereby the first hole in the fan-shaped member is aligned with the blocking axle when the runway board is in the use position and the second hole is aligned with the blocking axle when the runway board is in the storage position, such that, when the blocking axle is extended, it engages one of the first and second spaced apart holes to lock the runway board in either use or storage positions.

2. The fastener of claim 1 wherein the pull button is attached to the plate.

* * * * *